United States Patent [19]

McCormick

[11] Patent Number: 4,869,694

[45] Date of Patent: Sep. 26, 1989

[54] MOUNTING DEVICE FOR MARINE PROPELLERS AND THE LIKE

[75] Inventor: Daniel F. McCormick, Oshkosh, Wis.

[73] Assignee: Brunswick Corporation, Skokie, Ill.

[21] Appl. No.: 197,769

[22] Filed: May 23, 1988

[51] Int. Cl.[4] ..... F16L 35/00

[52] U.S. Cl. ..... 440/83; 285/392; 403/370; 403/299; 403/16; 411/178

[58] Field of Search ..... 440/49, 78–83; 285/392, 357; 464/182, 183; 403/362, 370, 365, 299, 16; 411/178, 384, 389, 383

[56] References Cited

U.S. PATENT DOCUMENTS

| | | | |
|---|---|---|---|
| 1,948,110 | 2/1934 | Hobler | 411/178 |
| 2,438,744 | 3/1948 | Flynn | 411/178 |
| 2,549,484 | 4/1951 | Kiekhaefer | 440/78 |
| 2,630,775 | 3/1953 | Kiekhaefer | 440/75 |
| 3,587,510 | 6/1971 | Shimanckas | 440/75 |
| 4,317,655 | 3/1982 | Schiek | 440/78 |
| 4,655,479 | 4/1987 | Farr | 411/178 |

*Primary Examiner*—Joseph F. Peters, Jr.
*Assistant Examiner*—Clifford T. Bartz
*Attorney, Agent, or Firm*—Andrus, Sceales, Starke & Sawall

[57] ABSTRACT

A marine drive (1) for a boat (3) includes a longitudinally extending propeller shaft (18, 20) which concentrically carries the hub (21, 22) of a propeller (10, 11) at the aft end of the shaft, with the shaft serving to rotatably drive the hub. The shaft is provided with a threaded outer peripheral portion (48, 36) at its end. The hub is provided with a rearwardly disposed annular flange (44, 32) and an annular rearwardly facing recess (45, 33) having a threaded outer periphery (47, 35). A dual-threaded nut (49, 37) is removably disposed within the hub recess. The outer nut threads engage the hub threads, while the inner nut threads engage the threads of the propeller shaft. A device (56, 43) is provided for securing the nut against threadable rotation in its mounting. The inventive concepts may be utilized with a single or dual propeller system or any other hub and shaft connection.

7 Claims, 2 Drawing Sheets

MOUNTING DEVICE FOR MARINE PROPELLERS AND THE LIKE

BACKGROUND AND SUMMARY OF THE INVENTION

Reference is made to the present inventor's copending U.S. patent applications (1) Ser. No. 07/197,620, entitled "Marine Drive With Improved Propeller Mounting", and (2) Ser. No. 07/197,452, entitled "Marine Drive With Improved Propeller Shaft Bearing Carrier Arrangement"; both being filed on even date herewith.

This invention relates to a mounting device between a rotary shaft and a hub or other member mounted thereon and driven thereby, and more particularly to marine drive devices including a propeller shaft which rotatably drives a hub-mounted propeller thereon. When applied to the marine field, the invention can be utilized in both outboard motor and stern drive applications.

Referring to the above-named copending applications, it is desirable to mount one or more propellers on a propeller shaft in such a manner that shaft bearings and other elements can be brought rearwardly into the propellers as far as possible. The sets of mating conical surfaces described in the above first-named copending application serve this purpose. In some instances, however, it may be desirable to utilize a construction other than mating conical surfaces, such as when a marked change in shaft diameter is not preferable.

It is an object of the present invention to provide a mounting device between a rotatable shaft and driven hub or the like mounted thereon which permits axial compaction of the elements in a simple and efficient manner without major changes in the shaft diameter.

In accordance with the various aspects of the invention, and as applied to a marine drive for a boat, the drive includes a longitudinally extending propeller shaft which concentrically carries the hub of a propeller at the aft end of the shaft, with the shaft serving to rotatably drive the hub. The shaft is provided with a threaded outer peripheral portion at its end. The hub is provided with a rearwardly disposed annular flange and an annular rearwardly facing recess having a threaded outer periphery. A dual-threaded nut is removably disposed within the hub recess. The outer nut threads engage the hub threads, while the inner nut threads engage the threads of the propeller shaft. A device is provided for securing the nut against threadable rotation in its mounting. The inventive concepts may be utilized with a single or dual propeller system or any other hub and shaft connection.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
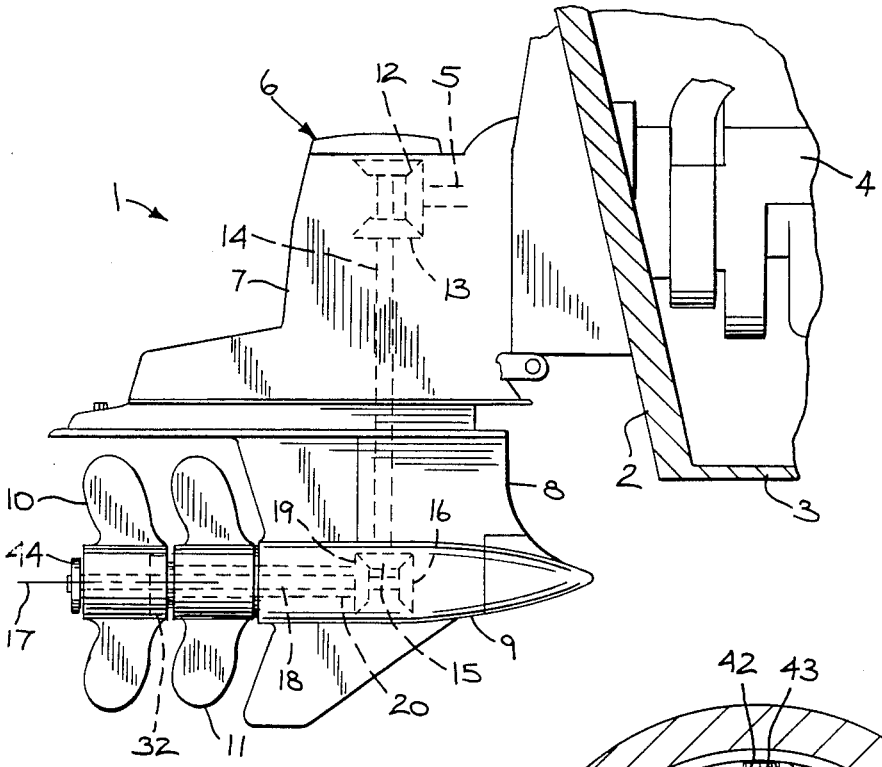
FIG. 1 is a generally schematic side elevation of a stern drive marine propulsion unit which incorporates the various aspects of the invention.
Figure 3:
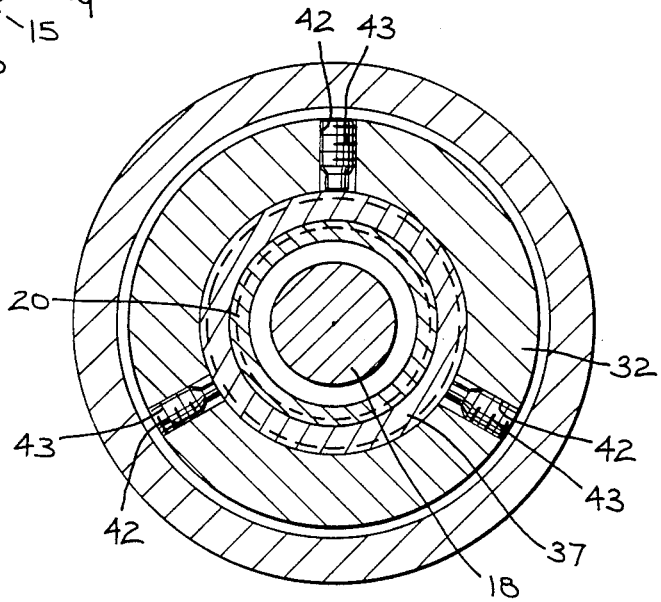
FIG. 3 is a transverse section taken on line 3—3 of FIG. 2.
Figure 4:
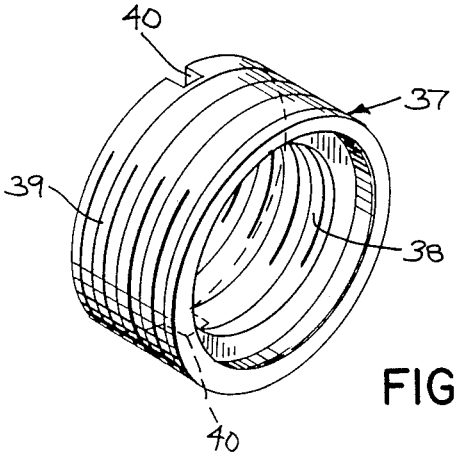
FIG. 4 is an isometric view of one of the dual threaded nuts.
Figure 2:
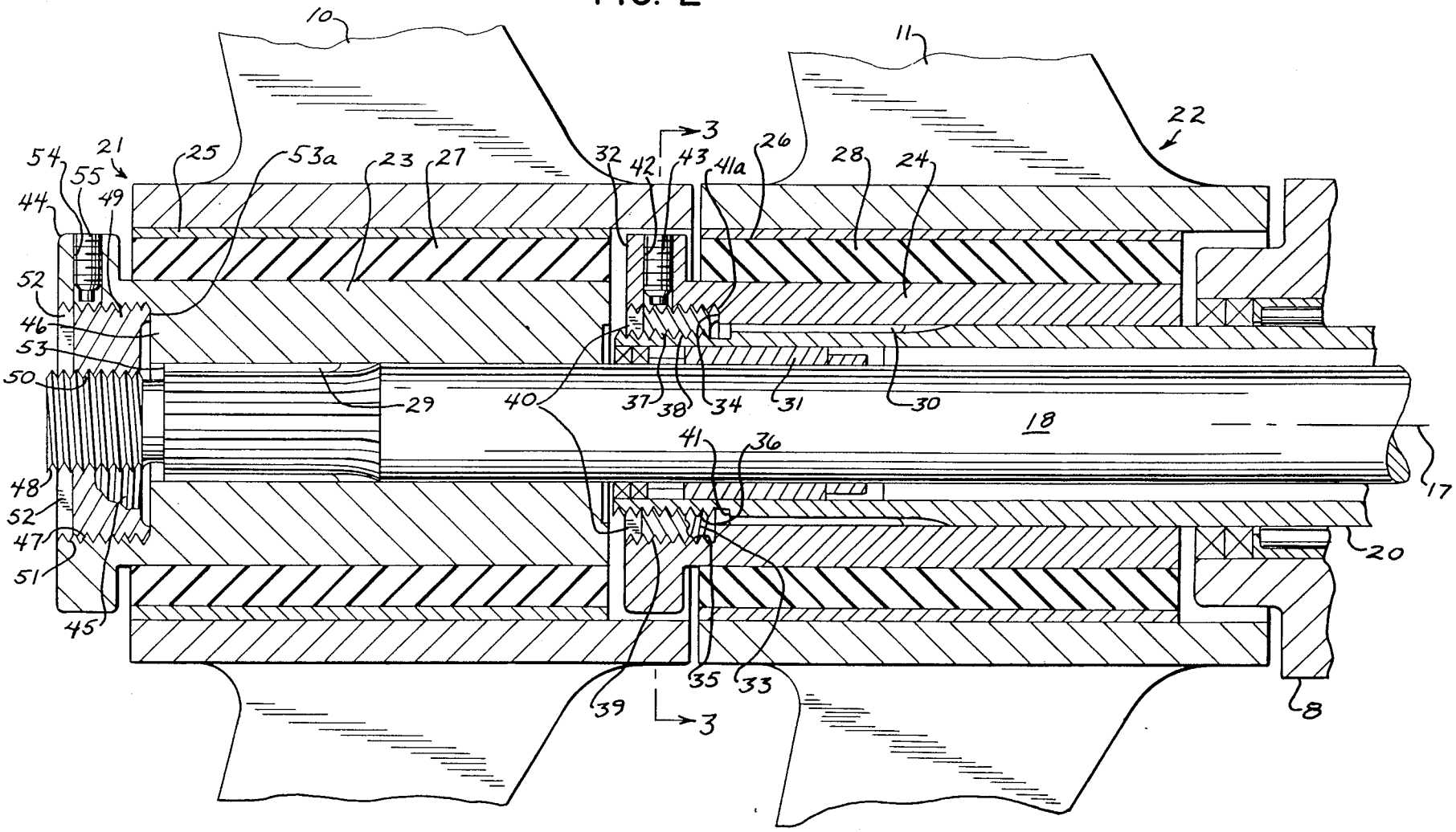
FIG. 2 is an enlarged generally vertical section of the lower aft end portion of the gear case.

FIG. 1 of the drawings illustrates the present invention as applied to a marine stern drive unit, although the inventive aspects are equally applicable to an outboard motor or other devices. As shown herein, stern drive unit 1 is adapted to be suitably mounted to the transom 2 of a boat 3. An internal combustion engine 4 is disposed within the boat and includes an output with a shaft 5 which extends through transom 2 to unit 1, in the usual manner.

Stern drive unit 1 generally includes a stern drive housing 6 forming an upper gear case 7, a lower gear case 8 suitably mounted to gear case 7, and a generally horizontally fore-to-aft extending torpedo housing 9 forming a portion of and disposed at the bottom of gear case 8.

Although certain aspects of the invention may be applicable to a single propeller device, in the present embodiment a pair of coaxially mounted propellers 10 and 11 are mounted for rotation generally aft of housing 9. For purposes of driving propellers 10 and 11, a pinion 12 is disposed on the outer end of shaft 5 and meshes with a gear 13 mounted to the upper end of a vertical main drive shaft 14 within upper gear case 7. Main drive shaft 14 extends downwardly and into lower gear case 8, and is provided with a pinion 15 on its lower end. Pinion 15 meshes with a forwardly disposed rearwardly facing driving gear 16 mounted for rotation about a horizontal propeller drive axis 17. Gear 16 is splined or otherwise mounted on and for rotation with a central axial longitudinally extending first propeller shaft 18.

Furthermore, pinion 15 meshes with a rearwardly disposed forwardly facing driving gear 19 which is also mounted for rotation about drive axis 17. Gear 19 forms the forward end portion of a longitudinally extending second propeller shaft 20 which is generally tubular and concentric with shaft 18.

Shafts 18 and 20 are supported for rotation within torpedo housing in any suitable well-known manner.

As schematically shown in FIG. 1, rear propeller 10 is mounted to the rearward end of central first propeller shaft 18, while front propeller 11 is mounted to the rearward end of second propeller shaft 20. The result is to provide contra-rotating propellers.

Propellers 10 and 11 are provided with central hub assemblies 21 and 22 respectively. Assemblies 21 and 22 are shown as including respective inner cylindrical hub portions 23, 24 and respective outer cylindrical hub portions 25, 26 with respective rubber shock hubs 27, 28 therebetween.

Cooperative splines 29, 30 respectively mount hub portion 23 of hub assembly 21 to the aft end portion of propeller shaft 18, and hub portion 24 of hub assembly 22 to the aft end portion of propeller shaft 20. In addition, a suitable bearing 31 is shown as being disposed between shaft 18 and the aft end portion of shaft 20.

Turning first to the mounting of forward hub assembly 22 for propeller 11, and in accordance with various aspects of the invention, hub portion 24 is provided with a radially outwardly extending annular flange 32 which is adapted to be disposed just beyond the aft end of propeller 11. In addition, an annular groove or recess 33 is disposed in the aft end of hub portion 24 and extends axially forwardly of flange 32. The bottom of recess 33 forms a locating surface 34. The outer periphery of recess 33 is provided with threads 35. In addition, the outer periphery of the aft end of outer propeller shaft 20 is also provided with threads 36 which, in diameter, closely approximate the outer shaft diameter within propeller 11.

For purposes of mounting hub portion 24 to shaft 20, a cylindrical double-threaded open-ended nut 37 is provided, with nut 37 having threads 38 on its inner periphery and threads 39 on its outer periphery. The threads per inch of both threads 38 and 39 should be equal. Furthermore, notches 40 are disposed on the aft end of nut 37 to receive a suitable tool (not shown) for manipulating the nut. A shoulder 41 on shaft 20, axially inwardly of threads 36, is positioned so that it is forward of locating surface 34 when nut 37 is telescopingly threadably inserted into recess 33. The inner threads 38 of nut 37 coengage with threads 36 on propeller shaft 20; and outer nut threads 39 coengage with outer threads 35 in hub recess 33. The nut is threadably rotated until its relieved forward end portion forming an annular rim 41*a* engages locating stop surface 34. Ultimate coengagement by rim 41*a* of nut 37 and surface 34 serves to locate hub assembly 22 axially relative to shaft 20.

Means are provided to secure nut 37 against threadable rotation in its mounting, which thus will hold hub assembly 22 and shaft 20 in located position. For this purpose, a plurality of circumferentially spaced threaded radial bores 42 in hub flange 32 receive adjustable set screws 43 which tighten onto the outer threads 39 of nut 37.

The construction is such that splined portions 30 drive hub assembly 22 and propeller 11 in rotation, while the coengaging threads 35,39 and 36,38 provide means to carry the fore and aft thrust.

Turning now to the mounting of aft hub assembly 21 for propeller 10, and in accordance with the aspects of the invention, hub portion 23 is also provided with a radially outwardly extending annular flange 44 which is adapted to be disposed just beyond the aft end of propeller 10. In addition, an annular groove or recess 45 is disposed in the aft end of hub portion 23 and extends axially forward of flange 44. The bottom of recess 45 forms a locating surface 46. The outer periphery of recess 45 is provided with threads 47. In addition, the outer periphery of the aft end of inner propeller shaft 18 is also provided with threads 48 which, in diameter, closely approximate the outer shaft diameter within propeller 10.

For purposes of mounting hub portion 23 to shaft 18, a cylindrical double-threaded nut 49 is provided, with nut 49 being coaxial with nut 37 and having threads 50 on its inner periphery and threads 51 on its outer periphery. The threads per inch of both threads 50 and 51 should be equal. Furthermore, notches 52 are disposed on the aft end of nut 49 to receive a suitable tool (not shown) for manipulating the nut. A shoulder 53 on shaft 18, axially inwardly of threads 48, is positioned so that it is forward of locating surface 46 when nut 49 is telescopingly threadably inserted into recess 45. The inner threads 50 of nut 49 coengage with threads 48 on propeller shaft 18; and outer nut threads 51 coengage with outer threads 47 in hub recess 45. The nut is threadably rotated until its relieved forward end portion forming an annular rim 53*a* engages locating stop surface 46. Ultimate coengagement by Rim 53*a* of nut 49 and surface 46 serves to locate hub assembly 21 axially relative to shaft 18.

Means are provided to secure nut 49 against threadable rotation in its mounting, which thus will hold hub assembly 21 and shaft 18 in located position. For this purpose, a plurality of circumferentially spaced threaded radial bores 54 in hub flange 44 receive adjustable set screws 55 which tighten onto the outer threads 51 of nut 49.

The construction is such that splined portions 29 drive hub assembly 21 and propeller 10 in rotation, while the coengaging threads 47,51 and 48,50 provide means to carry the fore and aft thrust.

The concepts of the invention provide a unique mounting device between a rotatable shaft and a member mounted concentrically thereon.

Various modes of carrying out the invention are contemplated as being within the scope of the following claims which particularly point out and distinctly claim the subject matter of the invention.

I claim:

1. In a marine drive, the combination comprising:
(a) a generally vertical drive housing (6) terminating in a lower torpedo housing (9),
(b) a propeller shaft (20, 18) disposed within and extending longitudinally rearwardly from said torpedo housing in a generally fore-to-aft direction, and with said shaft being rotatable on a longitudinal drive axis (17),
(c) a propeller (11, 10) disposed on the rearward portion of said shaft, and with said propeller having a concentric hub (22, 21) secured for driving rotation by said shaft,
(d) and means mounting said propeller to said shaft;
(e) said mounting means including a generally cylindrical double threaded nut (37, 49) having external (39, 51) and internal (38, 50) threads,
(f) said nut being telescoped between, concentric with, and threadably coengaging with corresponding threads disposed on said hub and said shaft.

2. The combination of claim 1 wherein:
(a) the said corresponding threads (35, 47) on said hub (22, 21) are disposed in a recess (33, 45) disposed in the aft hub end, and with said last-named threads being engaged by said external threads (39, 51) of said nut (37, 49),
(b) and said corresponding threads (36, 48) on said shaft (20, 18) are disposed adjacent a rearward end of the latter and are engaged by said internal threads (38, 50) of said nut.

3. The combination of claim 2 which includes means (43, 55) for securing said nut (37, 49) against threadable rotation.

4. The combination of claim 2 wherein:
(a) said hub (22, 21) is provided with an outwardly radially extending flange,
(b) and an adjustable set screw (43, 55) threadably extends through said flange into engagement with said nut (37, 49).

5. The combination of claim 1 which includes locating means (34, 41; 46, 53) associated with said hub (22, 21) and said shaft (20, 18), and with said locating means being engageable by said nut (37, 49).

6. The combination of claim 2 or 3:
(a) which includes locating means (34, 41; 46, 53) associated with said hub (22, 21) and said shaft (20, 18), and with said locating means being engageable by said nut (37, 49), (b) said locating means including a locating surface (34, 46) at the bottom of said recess (33, 35).

7. The combination of claim 1:

(a) which includes dual propeller shafts (20, 18) mounting dual forwardly and rearwardly disposed propellers (11, 10), each propeller having a hub (22, 21) secured for driving rotation by a respective shaft, (b) and a said mounting means is associated with each of said dual propeller shafts and each said hub.

* * * * *